United States Patent [19]

Pamplin et al.

[11] 4,345,451

[45] Aug. 24, 1982

[54] WIRE DRAWING METHOD AND APPARATUS

[75] Inventors: John W. Pamplin, Auckland; Brian R. Astbury; Richard Shillito, both of Crook, all of England

[73] Assignee: Marshall Richards Barcro Limited, Crook, England

[21] Appl. No.: 101,561

[22] Filed: Dec. 10, 1979

[30] Foreign Application Priority Data

| | | | |
|---|---|---|---|
| Dec. 12, 1978 | [GB] | United Kingdom | 48053/78 |
| Jan. 30, 1979 | [GB] | United Kingdom | 7903285 |
| May 8, 1979 | [GB] | United Kingdom | 7915881 |

[51] Int. Cl.[3] ..... B21C 9/00; B21C 3/14; B21C 1/04; B21C 1/14

[52] U.S. Cl. ..... 72/286; 72/41; 72/289

[58] Field of Search ..... 72/286, 280, 289, 342, 72/39, 41

[56] References Cited

U.S. PATENT DOCUMENTS

| | | | |
|---|---|---|---|
| Re. 20,067 | 8/1936 | Busey | 72/342 |
| 1,096,866 | 5/1914 | Schinnerling | 72/286 |
| 1,727,664 | 9/1929 | Nacken | 72/289 |
| 1,737,345 | 11/1929 | Tideman | 72/289 |
| 1,901,920 | 3/1933 | McMullan | 72/286 |
| 1,986,021 | 1/1935 | Sjogren | 72/342 |
| 2,109,312 | 2/1938 | Dimmick | 72/39 |
| 2,179,348 | 11/1939 | Penney | 72/286 |
| 2,963,145 | 12/1960 | Bruestle | 226/190 |
| 3,106,354 | 10/1963 | Kitselman | 242/47.08 |
| 3,774,436 | 11/1973 | Tviksta | 72/342 |
| 3,841,129 | 10/1974 | Nishihara et al. | 72/280 |
| 4,080,818 | 3/1978 | Gre' | 72/41 |
| 4,149,398 | 4/1979 | Eichenlaub, Jr. | 72/289 |

FOREIGN PATENT DOCUMENTS

| | | | |
|---|---|---|---|
| 451031 | 9/1948 | Canada | 72/286 |
| 988335 | 5/1976 | Canada | 72/286 |
| 465100 | 9/1928 | Fed. Rep. of Germany . | |
| 1916256 | 3/1976 | Fed. Rep. of Germany . | |
| 528642 | 11/1921 | France . | |
| 28336 | 2/1925 | France . | |
| 2226224 | 11/1974 | France . | |
| 165732 | 9/1922 | United Kingdom . | |
| 1249926 | 10/1971 | United Kingdom . | |
| 1260490 | 1/1972 | United Kingdom . | |
| 1405419 | 9/1972 | United Kingdom . | |
| 1428889 | 3/1976 | United Kingdom . | |

*Primary Examiner*—Daniel C. Crane

*Attorney, Agent, or Firm*—Prutzman, Kalb, Chilton & Alix

[57] ABSTRACT

Method and apparatus for drawing wire which uses a partial turn of wire wedged in an endless groove in a rotating wheel to generate the necessary drafting tension and wherein the drawn wire is cooled by direct contact with a liquid coolant as it leaves the die and while it is wedged in the groove. In a multi-stage apparatus, the coolant is removed from the wire downstream of the wheel and upstream of the next sizing opening by an air wipe.

26 Claims, 10 Drawing Figures

WIRE DRAWING METHOD AND APPARATUS

TECHNICAL FIELD AND BACKGROUND ART

This invention relates to an improved method of drawing wire and an improved wire drawing apparatus.

It is conventional practice to draw wire through a drawing die by wrapping the wire many times around a rotatable drawing block downstream of the die and using the engagement of the wire around the block to generate the drafting tension required for pulling the wire through the die. This method of drawing wire (hereinafter referred to as the capstan block method) has been widely used for many years and many different designs of apparatus for operating the method have been developed. To get adequate tension for drawing the wire through the die it is necessary to wrap the wire several times around the block and it has become conventional practice to extract from the wire the heat generated by the drawing process by cooling the wire while it is on the capstan block. The longer the dwell time of the wire on the block surface, the more effective the cooling can be and there has thus been a trend towards increasing the number of turns on the block and therefore also the size of the block beyond that necessary for traction purposes to meet the cooling requirement as drafting speeds increased. However, a large number of turns on each capstan block of a multiple die machine increases the complexity and cost of the machine and makes the threading up of the machine complicated and time-consuming.

In U.K. Pat. No. 1,249,926 (BISRA) it has been purposed to cool the wire while it is on the capstan block, by directly contacting it with liquid coolant sprays and in U.K. Pat. No. 1,428,889 (Kobe) it has been proposed to cool the wire as it leaves the drawing die by surrounding the wire with liquid coolant between the die and the capstan block.

In U.S. Pat. No. 1,918,237 (Alden), a multiple die wire drawing apparatus is disclosed in which a light finishing pass is provided by a driven grooved pulley interposed between the last die of the apparatus and the take-up reel, the wire being engaged by the groove of the driven pulley over an arc of less than 360° subtended at the axis of the pulley.

This invention relates to a new concept in wire drawing methods and apparatus which combines direct wire/liquid coolant cooling and the use of a simple grooved wheel in place of a conventional capstan drawing block.

Preferred embodiments of apparatus in accordance with the invention are expected to be less expensive than equivalent capstan block apparatus, they are easier to operate and service and are capable of drawing wire with improved efficiency compared to capstan block apparatus.

DISCLOSURE OF INVENTION

According to one aspect of the present invention a wire drawing method comprises pulling the wire through a drawing die by wedging the wire in an endless groove of a rotating drawing wheel through an arc of less than 360°, directly cooling the wire between the die and the wheel with a flow of liquid coolant, and maintaining the wire in contact with the liquid coolant while it is in the groove.

Preferably the coolant forms a moving column of liquid which surrounds the wire as it leaves the die and as the wire enters the groove. Suitably the liquid forming such a column also cools the drawing die and, at least initially, is directed to turn helically around the hot drawn wire.

Suitably the groove in the drawing wheel is of an approximate V-form, and an included angle of between 15° and 25° would be typical, with angles between 15° and 20° preferred. The V-groove may be symmetrical about a plane normal to the rotating axis of the wheel. In a wire drawing apparatus having a plurality of stages using successively smaller drawing dies, if identical drawing wheels are used in the plurality of stages, the wire will contact different regions of the groove in each stage. The smaller the diameter of the wire being drawn at a particular stage, the smaller the radii of the arcs of contact of the wire in the groove and vice versa. This means that in a multiple die apparatus there is the possibility of substituting the wheels progressively along the apparatus to prolong the useful life of the wheels before their groove surfaces require reconditioning.

It has been found that if the wire is wedged within a groove in the surface of a rotating wheel, adequate drafting tension can be generated for the heaviest gauges of ferrous wire currently drawn on conventional capstan block machines even though the wire contacts the wheel over an arc of less than 360°. Arcs of contact of between 270° and 180° have been found to be sufficient in practice.

Of substantial significance, it has been found that the heat generated by the heaviest drafting schedules can be effectively dissipated during the very short time interval the wire is passing to the wheel and is retained in the groove of the wheel. With conventional prior art capstan blocks (e.g. with typically 20–100 turns of wire on the block), the transit time during which the wire was on the block ranged from say 10 to 100 seconds. At comparable drawing speeds and with a grooved wheel of comparable diameter to that of the capstan block, the time available for cooling the wire in a method according to the invention is very much reduced, the entire cooling being effected in say 0.1 to 5 seconds.

According to a further aspect of the present invention, apparatus for changing the cross-section of wire in its passage along a transport path from an inlet of the apparatus to an outlet of the apparatus comprises, a drawing die of the desired cross-section through which the wire is to be drawn, a rotatable wheel having an endless groove therein, which groove defines part of said path and has a cross-section which tapers in the direction towards the axis of rotation of the wheel, so that the wire is wedged in the groove intermediate the radially innermost and radially outermost parts thereof for a part only of one turn around the axis of the wheel, guide means to lead the wire out of the groove to the said outlet, means to surround the wire with liquid coolant as it leaves the die and to contact the wire with liquid coolant while it is in the groove, and means to rotate the wheel to effect smooth transport of the wire along the said transport path.

Suitably the liquid coolant used to contact the wire immediately downstream of the die not only fills the groove up to the wire engaged therein but is also retained against the radially outer surface of the wire in the groove by a cowl closely confronting the periphery of the rotating wheel. The cowl can be of channel-section and baffles can be provided in the channel to slow the progress of coolant along it and ensure that good contact between the coolant and the wire is obtained throughout the entire arc of wire/wheel contact.

It is possible to completely immerse the wheel in a bath of coolant and to position the drawing die at the level of the free surface of the bath.

The angular extent to which the wire engages the wheel can be varied within wide limits. At one extreme, substantially tangential contact with the wheel (e.g. the wire is wedged in the groove over an arc subtending only a few degrees) can be employed as in the case of drawing soft wires or where only minor changes in size and/or shape of the cross-section of the wire is effected at the die. The transport path can include wedging engagement of the wire in more than one wheel (which can all be rotating in the same direction or with one or more wheels rotating in the opposite direction). At the other extreme, the wire can remain wedged in the groove over an arc in excess of 270° so that the transport path crosses itself between the inlet and the outlet.

Between these extremes, other arrangements are possible, such as having the transport path loop through 180° around the axis of the wheel (i.e. giving an arrangement in which the inlet and outlet are disposed on the same side of the apparatus) or using two wheels one after the other, with an arcuate wire engagement of between 45° and 90° on each wheel.

In the case of a multiple die apparatus, the coolant is normally removed from the wire upstream of the position at which the wire is lubricated for entry into a succeeding stage die and such removal is essential if the lubricant is impaired by coolant contamination.

Since the wire path in its passage around the wheel remains in a single plane within the accurate groove in the wheel, automatic threading-up of a multiple die apparatus according to the invention is much easier to achieve than would be the case in a multiple die capstan block machine. A suitably long taper can be provided on the leading end of wire to be fed into the apparatus and guide means provided to lead that tapered end through the dies and into the grooves of the wheels in succession, the rotation of the wheels being automatically controlled in sequence as the tapered end of the wire advances through the apparatus.

Since less than one single turn of wire engages each wheel, the wire paths to and from each wheel need be displaced by little more than one diameter of the wire where the wire crosses and whereby there need be little displacement of the wire out of a single plane from the inlet end of a multiple die apparatus to its outlet end. The resulting substantially planar wire path through the apparatus greatly facilitates a fully automatic threading-up operation.

Where a powdered lubricant is employed upstream of each die, the powdered lubricant would normally be located in a soap box through which the wire passes immediately before entering the die. In that event, some means must be used in multiple die apparatus to remove residual liquid coolant from the wire prior to its entering each succeeding soap box if the wire must be dry for effective lubrication. An air wipe is preferred, using axially directed compressed air streams which surround the wire to blow any remaining liquid coolant from the wire surface. To improve soap utilization, it is advantageous to use a constantly circulating lubricant supply through each soap box. The lubricant powder can be drained from each soap box, to facilitate threading-up.

Conveniently the drawing wheels of a multiple die apparatus are disposed with their grooves lying in parallel planes or in a common plane and with the rotating axes of the wheels disposed horizontally. Suitably the axes of all the wheels lie in a common horizontal plane.

Suitably each wheel is located within a casing so that the part turn of wire wedged in its groove can be drenched with liquid coolant during use of the apparatus, without that coolant impinging on coolant-free parts of the wire path. The coolant used can collect in a trough (suitably forming part of the base of the apparatus) and be filtered and optionally cooled before being returned to the casings. A recirculating coolant system can be provided in this way.

Conveniently the wheels are made in two parts which are suitably fastened together at a meeting plane which passes through the groove. This facilitates the manufacture of the wheels and by suitably shaping the two parts enables a new groove to be formed merely by reversing the two parts and fastening them together again back to back. Conveniently the control of the torque applied to the wheels in a multiple die apparatus, and hence their relative rotational speeds, is effected either by sensing the position of a dancer pulley between each wheel and the next downstream die or by sensing the tension generated by the wire on a fixed guide pulley disposed between each wheel and the next downstream die. Preferably, in the latter case, the journals mounting the guide pulley are connected to a force transducer (e.g. a load cell) which generates an electrical signal in accordance with the magnitude of the wire tension at each drawing die.

Conventional electrical control circuits can be used to convert the outputs of the force transducers into torque control signals for the respective motors.

To avoid the need to adjust the alignment of soap boxes and wheel grooves as the die sizes are changed on setting up the apparatus for a different drafting sequence, preferably wheel V-grooves are used which have cross-sections symmetrical about a radial plane passing through the apex of the V. Semi-angles in the range of 7½° to 12½° are typical for the V-grooves with semi-angles of between 7½° and 10° preferred. The grooves should be deep enough to receive the thickest input material likely to be used and the inclined sides of the V-groove should continue deep enough to wedge the finest wire likely to be drawn. Experience has shown that the method and apparatus of the invention can be used with both ferrous and non-ferrous wires of both circular and non-circular cross-section.

Drafting pulls of 25,000 Kg are obtainable with a V-groove with area reductions per hole in excess of 40% easily realizable. Although cooling has to be accomplished in a much shorter time than with prior art capstan machines, 33 KW of power has been successfully dissipated at the first stage of a multiple die apparatus with an output wire temperature from that stage of less than 90° C. (representing a temperature increase of less than 75° C.). Similar results are achieved at succeeding stages of a multiple die apparatus to hold the wire output temperature at each stage within an acceptable limit. Drafting speeds in excess of 22 meters/-second have also been achieved and it is expected that drawing speeds at least equal to the best obtainable in prior art capstan machines can be obtained. Galvanized and ungalvanized ferrous wires can be drawn on the same apparatus without difficulty. To facilitate automatic or manual threading of the apparatus it is desirable to employ static wire guides to constrain the leading end of a length of wire to follow the intended path from a wheel to the next die and to mount feed rolls upstream of each die and its associated lubricant supply means. Normally some means will be employed to temporarily hold the wire in the downstream end of the groove in each wheel during threading-up and conveniently the wire hold down means can be initially positioned approximately at the point along the wire path where the wire first contacts the groove and then shifted with the wire to approximately the point along the wire path where the wire leaves the wheel groove during normal running. A rotatable roller which can enter the groove provides a suitable holding means and such a roller can be mounted on a radius arm to pivot, or be pivoted, about the axis of the wheel during the threading-up operation.

The drawing dies can be of any conventional kind (e.g. fixed dies or roller dies) but fixed dies would be the normal choice.

BRIEF DESCRIPTION OF DRAWINGS

The invention will now be further described, by way of example, with reference to the accompanying drawings, in which.

BEST MODE FOR CARRYING OUT THE INVENTION

Figure 1:
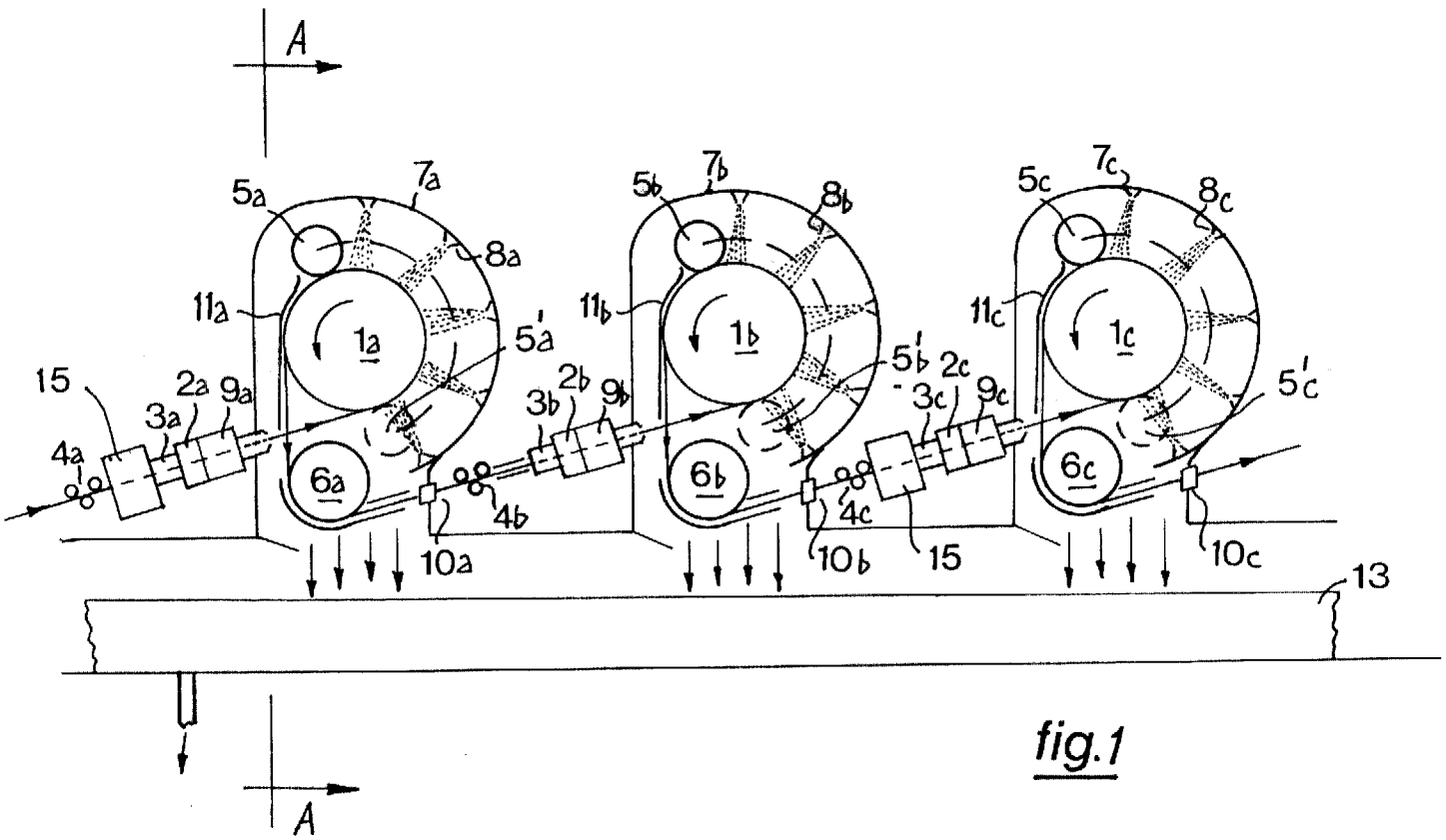
FIG. 1 is a schematic side elevation view of one form of apparatus in accordance with the present invention.

The apparatus shown in FIG. 1 represents just three drawing stages of a wire drawing machine. The total number of drawing stages is a matter of choice but something between three and ten stages would be likely in a multiple die apparatus.

Figure 3:
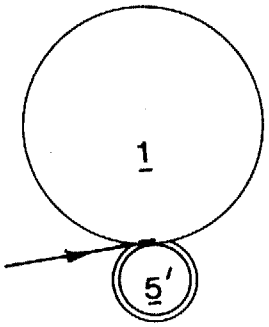
Figure 4:
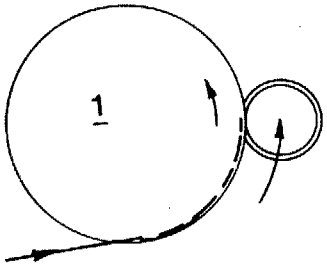

In FIG. 1 the letters "a", "b" and "c" have been used to distinguish between the three different stages of the machine, the same reference numerals being employed for similar integers in the different stages. Subscript letters are not used in FIGS. 3 to 5 since the operations described with reference to those Figures apply equally to all of the stages of the machine.

In FIG. 1, 1 designates a rotatable grooved drawing wheel, 2 a die box containing a suitably sized fixed die, 3 a soap box containing powder lubricant for the die, 4 a set of driven feed rolls for advancing a pointed end of wire into the die in the die box 2, 5 a pressure roller for holding the wire in the groove in the wheel 1, 6 a guide pulley, 7 a liquid-tight casing, 8 spray nozzles within the casing, 9 a die/wire cooling unit for cooling the rear face of the drawing die and the outgoing wire and 10 an air wipe forming an outlet to the casing 7. The wire path through the three stages a, b and c shown in FIG. 1 involves the wire being wedged in the groove in each drawing wheel 1*a*, 1*b* and 1*c* over an arc of approximately 270°. The pressure roller 5 is normally located in the position shown in full lines in FIG. 1 (i.e. close to the point where the wire finally leaves the groove in the wheel 1) but is able to be swung round the periphery of the wheel, in the clockwise direction, into the position 5' shown in dashed lines, to contact the leading end of the wire as it first enters the groove on the occasion of threading-up. This threading-up procedure is explained in greater detail with reference to FIGS. 3 to 5.

As the wire leaves the groove in the wheel 1 in each stage, it passes vertically downwardly (adjacent to a stationary wire guide 11) and then passes around the guide pulley 6 through just over 90° into a slightly upwardly inclined path through the wipe 10 to the next feel roll/soap box/die box configuration. A second stationary wire guide extending partly around the pulley 6 leads wire to the pulley 6 and from the pulley 6 to the wipe 10.

From the moment the wire leaves the die in the die box 2 to the time it reaches the wipe 10 it is in contact with moving flows of a liquid coolant. The coolant unit 9 provides for feeding a liquid coolant, preferably water, to surround the wire with a turbulent column of liquid coolant as the wire leaves the die, and so that a column of liquid coolant is fed with the wire into the groove of the wheel 1 to become trapped by the wire in the groove. Additional coolant is supplied by the nozzles 8 for cooling the wire while it is on the wheel. The coolant draining from each stage casing 7 is collected in a tank 13 forming part of the base of the machine. Coolant filtering and recirculating means (not shown) are provided to draw coolant from the tank and return it to the coolant units 9 and the casing nozzles 8. Cooling of the recirculating coolant may be provided if required.

Recirculation of coolant is desirable from environmental considerations but if not required, the tank 13 can be dispensed with, the coolant outflows then being led directly to waste.

The coolant would normally be pure water but a small proportion of property-modifying additive (e.g. an emulsified lubricating oil) can be added if desired.

The front face of each casing 7 is connected by means of a parallel linkage to a suitable support behind the casing (as shown in broken lines in FIG. 2) and can be counterbalanced to facilitate its removal upwardly from the rest of the casing when access to the wheel is required. Suitable clamps (not shown) can be provided to lock the front face in its lower closed position so that it can serve as a secure safety guard for machine operators.

Figure 5:
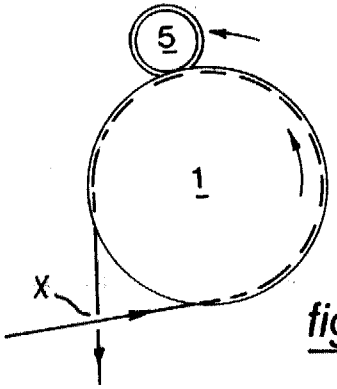
Figure 2:
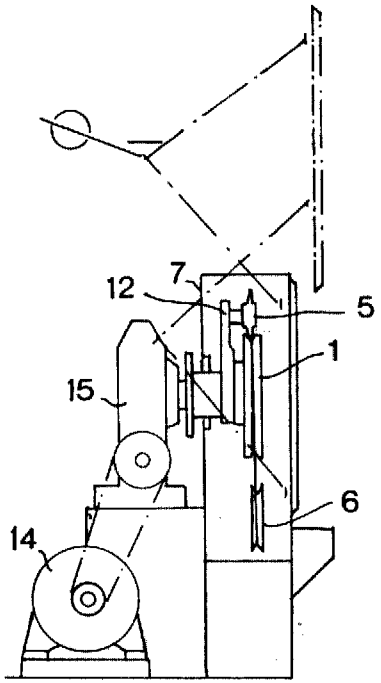
FIG. 2 is a transverse elevation view of the apparatus in the direction of the arrows A—A in FIG. 1, FIGS. 3 to 5 schematically indicate the procedure adopted during threading-up of the apparatus of FIG. 1.

The off-set between the wire paths at the point marked X in FIG. 5 (where the wire completes its encirclement of the axis of the wheel 1) need by only fractionally more than the diameter of the wire at that stage and can be provided by slightly axially off-setting the pulley 6 as shown in FIG. 2. Off-sets as small as this (a maximum of a few mm in practice) can easily be suitably accommodated for in the wire path between the pulley 6 and the succeeding die box 2 by employing a suitable entrance guide (not shown) at the soap box 3, and whereby the inlet path of wire to the first stage die of the machine is coplanar with the path of wire leaving the last stage die and the entire wire path is generally planar through all of the stages of the machine. Even if no accommodation for the off-set is made between succesive stages of the machine, the total off-set between the inlet wire path and outlet wire path need be no more than a few centimeters. The apparatus illustrated thus gives rise to a machine which, from considerations of wire path, can be very narrow in the axial direction (i.e. normal to the plane of the paper in FIG. 1).

FIG. 2 shows a motor 14 and a gear box 15 in the drive to the drawing wheel 1. Each stage has its own motor and the different motors need to be accurately controlled to ensure that the correct torque is applied to each wheel having regard to the wheels upstream and downstream of it and the area reductions occurring in the dies upstream and downstream of it. In the apparatus illustrated in FIG. 1, this control is influenced by the output of a force transducer (not shown) incorporated in the bearings of the guide pulley 6. The force transducer is employed to maintain a uniform back tension in the wire going to the downstream die. In one arrangement direct current motors are used for each drawing wheel, the outputs of the different stage transducers at the pulleys 6 being used to trim the respective armature voltage and/or field current of the wheel drive motors to maintain the back tension uniform during acceleration of the wheels to operating speed after threading-up and during extended operation at full operating speed.

The pressure roller 5 is freely rotatably mounted on the end of a radius arm 12 (see FIG. 2) and lightly presses the wire into the groove in the wheel 1. The arm 12 can swing through an arc of about 180° (to move the roller between the full line and dotted line positions 5 and 5' shown in FIG. 1), and the drive for this arcuate movement is taken from the drive shaft of the wheel 1. A clutch (not shown) which can be remotely operated can be used to couple the arm 12 to the wheel 1 when the roller is in its lower dotted line position 5' and the wheel is stationary. As the leading end of the wire is driven through the die in the die box 2 by the feed rolls 4 it is led into the groove in the wheel to pass below the roller in its lower position 5'. When the wire end reaches this position (shown in FIG. 3), its presence is suitably sensed (e.g. photoelectrically or with a microswitch) and the wheel 1 is inched forwards taking the radius arm 12 with it. After some 90° of rotation (i.e. when the pressure roller reaches the position shown in FIG. 4), the feed rolls 4 can be separated (removing drive from the wire upstream of the die) and the wire is then slowly drawn forward by virtue of its engagement in the groove of the wheel 1. When the pressure roller 5 reaches the position shown in FIG. 5, it is declutched automatically from the drive shaft of the wheel and remains in that position until the next threading-up operation is required. Slow rotation of the wheel 1 continues so that the leading end of the wire 1 is led automatically from the wheel 1 and around the pulley 6 (by the stationary guides 11 extending between the wheel 1 and pulley 6 and around the pulley 6), through the air wipe 10 and into the feed rolls 4 of the next drawing stage of the machine. In this way automatic threading-up of all stages of the machine can be effected, the wheels starting up one by one as the leading end of the wire advances through the machine. When the leading end of the wire finally exits from the casing 7 of the last stage of the machine, it can be led to a spool or other arrangement (not shown) provided for coiling the drawn wire and then the entire machine can be accelerated up to the full working speed.

In some cases it is possible to provide a sufficiently long "point" on the wire end before threading-up of the first die is commenced and so that the complete threading-up operation can be completed without having to re-point the leading end. Where this is not possible, or not desirable, additional pointing stations can be provided at intervals along the machine. Two such additional pointing stations 15 are shown in FIG. 1. These stations 15 can point the end by any convenient process (e.g. by swaging, rolling, grinding or cutting) and are power operated to reduce the diameter of the wire end as it passes through the pointing stations 15 during the threading-up operation.

The feed rolls 4 are used to drive the leading wire end forward between stages of the threading-up operation and are withdrawn during the wire drawing operation.

Preferably the lubricant in the soap box 3 does not obstruct the wire path through the box 3 during the threading-up operation, and for that purpose, each stage soap box 3 is suitably designed to be opened for removing the soap lubricant therein before the threading-up operation is initiated. Also, to ensure that lubricant is economically used during a wire drawing operation, it is desirable to arrange for the lubricant to be replenished (or recirculated as desired) during use of the machine, lubricant in the soap box 3 being replaced by re-mixed lubricant. Desirably therefore the apparatus is designed so that removal of the lubricant from the wire path for the threading-up operation and its subsequent return to the wire path should be accomplished automatically as part of the threading-up operation.

Figure 6:
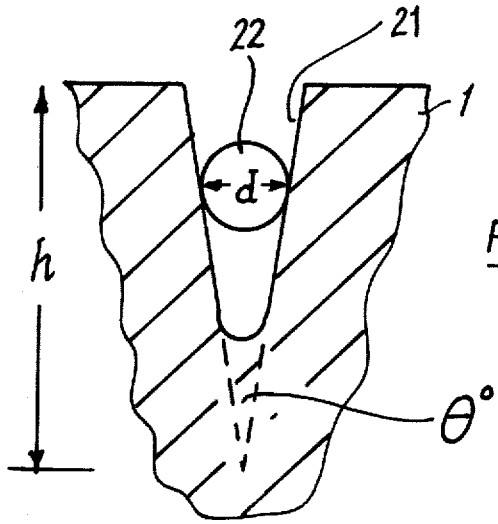
FIG. 6 is an enlarged partial section view of a drawing wheel showing a typical wire/wheel wedging arrangement of the type employed in the apparatus of FIG. 1.

FIG. 6 shows an enlarged transverse section view of part of a grooved wheel 1. A symmetrical groove is shown at 21 and the wire at 22. The groove need not be symmetrical however. Since the wire 22 enters the groove 21 until it becomes wedged therein, a single V-groove can be used for a wide range of different wire sizes, the limiting criteria being on the one hand that the wire does not bottom in the groove before it is adequately wedged within the groove (i.e. the radially innermost part of the groove has a transverse dimension (i.e. groove width) which is less than the minimum dimension of the cross-section of the drawn wire), and on the other hand that the wire sufficiently enters the groove to become effectively wedged therein. Wire diameters between 10 and 25 mm could conveniently be used in a groove having an angle of 18° and a depth "h" (see FIG. 6) of 100 mm.

The groove angle ($\theta$°) typically lies in the range of 15° to 25° and preferably in the range of 15° to 20°.

The necessary traction for drawing the wire through the die openings is provided by the frictional engagement of the wire 22 in the groove 21 of each wheel 1. The theory of such groove-induced traction can be appreciated by considering FIG. 7 which plots the semi-angle $\alpha$ (i.e. one-half the groove angle) of a symmetrical V-groove 21 as abscissa against the ratio of forward tension ($T_1$) and back tension ($T_2$) in the wire 22 (plotted on a log scale) as the ordinate. Just prior to wire/wheel slip occurring, the maximum ratio of $T_1/T_2$ for a symmetrical V-groove having an angle $2\alpha$ is given by:

$$T_1/T_2 = \mu\theta/e \sin \alpha$$

where $\mu$ is the coefficient of friction between the wire 22 and the wheel 1, $\theta$ is the angle of wrap (in radians) around the axis of the wheel and e is the base of Naperian Logs.

Figure 7:
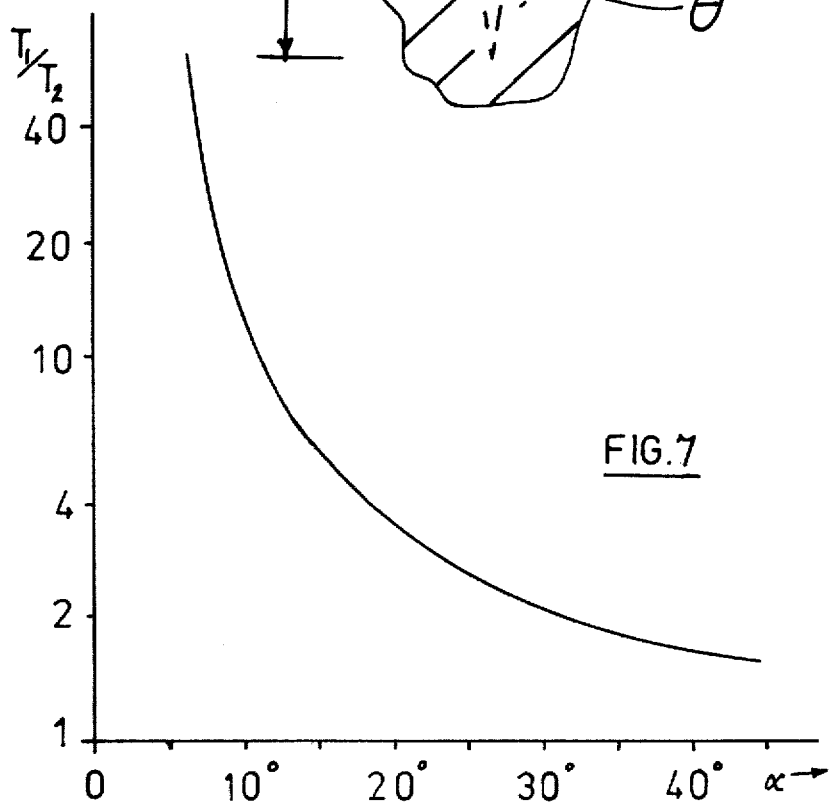
FIG. 7 is a graph illustrating the drawing theory employed in the operation of the apparatus shown in FIG. 1.

It is this expression which is portrayed in FIG. 7. Assuming a coefficient of friction of 0.15 and an angle of wrap of 180°, to achieve a ratio of $T_1/T_2$ which exceeds 10, and angle $2\alpha$ less than 23½° is required and to facilitate easy insertion of the wire into the groove and removal therefrom, angles of $2\alpha$ less than 15° are undesirable. Thus the preferred range for the angle $2\alpha$ is between 15 and (say) 25°.

In the case of an asymmetrical V-groove (of angle $\beta$) where one side of the V-groove is formed by a radial plane, this ratio becomes $$\frac{T_1}{T_2} = e^{\mu\theta(1+\cos\beta)/\sin\beta}$$

The asymmetric groove is marginally less effective than the symmetrical V-groove but the curve would be very similar to that shown in FIG. 7. Once more a useful range for the angle $\beta$ would be between 15° and 25°.

Figure 8:
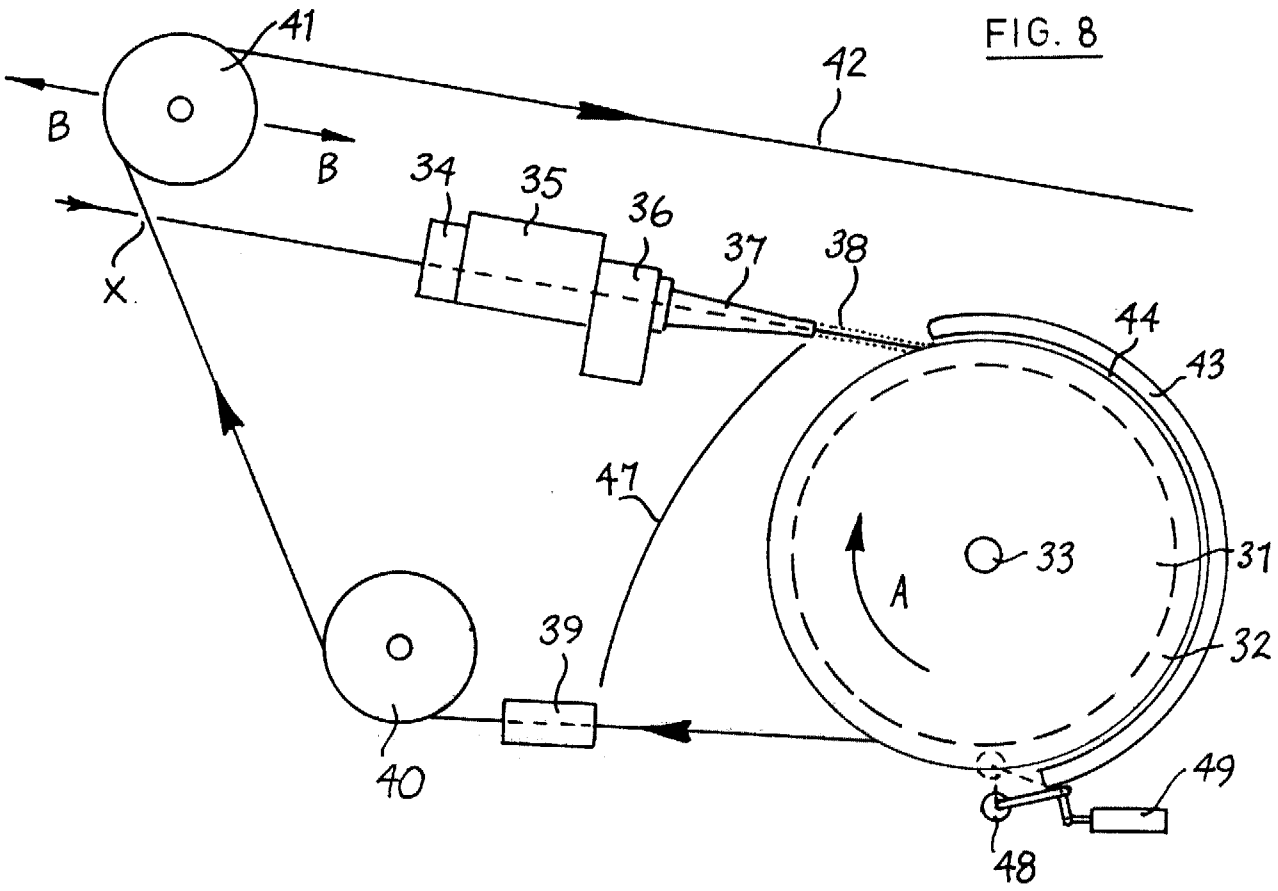
FIG. 8 is a generally schematic view of one stage of a modified form of wire drawing apparatus in accordance with the invention.

FIG. 8 shows the wire path for one stage of a modified multiple die wire-drawing apparatus with the wire entering the stage illustrated from the left as viewed in FIG. 8 either from a spool of input material or from a preceding stage. A wheel 31 is provided with a circumferential V-groove 32 is rotatably mounted about a horizontal axis 33 for rotation in the direction of the arrow A and by virtue of trapping of the wire in the groove 32 draws the wire through a guide 34, a soap box 35 and a draw die 36. Downstream of the die 36 there is provided an elongated tubular shroud or jacket 37 which forms an elongated coolant chamber for conducting a coherent column of liquid coolant around the wire as it exits from the die and so that the column of water emerges from the shroud surrounding the wire as shown at 38 to be conducted to the V-groove surface of the wheel 31, and so that part of the column of water is trapped below the wire in the groove 32. The trapped water within the groove 32 is held by centrifugal force in contact with the wire for effective wire cooling.

The wire is retained within the groove 32 for approximately 180° around the rotating wheel 31 and is then fed from the groove through an air wipe 39 and around guide pulleys 40 and 41. The air wipe 39 is provided to ensure that the wire 22 is completely dry before entering the soap box 35 of the next drawing stage. The upper or overhead wire path 42 leads on to the next stage of the machine or to a spooler for finished wire.

Guide pulley 41 can form part of a speed control system for one stage of the machine and its spindle is carried on a carriage (not shown) slidably mounted on a shaft (also not shown) for limited linear movement in opposite directions shown by the arrows B.

At the point X where the wire paths cross, a small clearance is provided between the wires (e.g. a clearance of 3 centimeters) and this clearance can easily be provided by slightly angling the axis of either or both of the guide pulleys 40, 41 relative to the axis of the V-grooved wheel 31.

A preferred design for the elongated tubular shroud or jacket 37 is detailed in the description accompanying our U.K. Pat. Application No. 7,915,880, filed May 8th 1979 now U.K. Pat. No. 2,050,902 and a preferred design of the soap box 35 is detailed in the description of our U.K. Patent Application No. 7,915,879 filed on the same day, now U.K. Pat. No. 2,048,145.

A column of water coolant 38 is trapped around the wire on the wheel 31 partly by filling the groove 32 up to the wire and partly by the provision of a cowl 43 closely surrounding the periphery of the wheel 31 around an arc of approximately 180°. The narrow gap 44 between the cowl 43 and the wheel 31 has been shown exaggerated in FIG. 8 and in practice would be of the order of a tenth of a mm. The cowl 43 is movably mounted on the machine to permit it to be withdrawn from the wheel 31 to facilitate the threading-up operation of the apparatus. A suitable stationary baffle 47 is provided to prevent the coolant from splashing off the wheel 31 into contact with the wire downstream of the air wipe 39.

A pressure roller 48, movable into and out of the groove 32 by means of a fluid cylinder 49, is used to facilitate threading-up, the roller being used to hold the wire in the groove 32 while sufficient wire is drawn for threading the next wheel and, if necessary, while the leading end is repointed.

Figure 9:
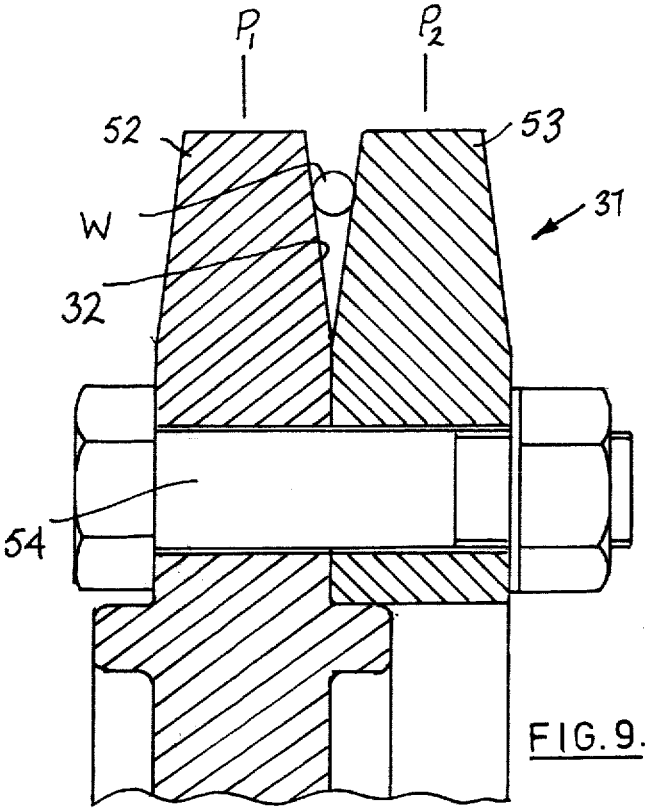
FIG. 9 is an enlarged partial section view showing a preferred form of construction of the grooved wheel employed in the apparatus shown in FIG. 8.

FIG. 9 shows an enlarged section of the periphery of a suitable form of wheel 31. The wire is shown at W wedged or trapped in a symmetrical groove 32 defined between coaxial circular wheel discs or parts 52 and 53. The wheel part 52 embodies a hub (not shown) for mounting the wheel on the wheel drive shaft and is formed to be symmetrical about a central radial plane $P_1$. The annular wheel part 53 is bolted to the part 52 by a ring of bolts 54 (only one of which is shown). The part 53 is also formed to be symmetrical about its central plane $P_2$. When the surfaces defining the groove 32 are worn at the arcs of contact of the wire W with the wheel, the bolts 54 can be removed and the part 53 reversed about its central plane $P_2$.

Since the part 52 is symmetrical about its hub, it can be reversed on the drive shaft to give a situation exactly as shown in FIG. 9 but with fresh surfaces defining the groove 32. In the case of a multiple die wire drawing apparatus with identical wheels used at the successive stages of the drawing process, worn wheels can be exchanged from one stage to another, since the arcs of contact of the wire in the wheel grooves 32 of different stages will be different.

Coolant is retained in the groove 32 by the cowl 33. The cowl can be an arcuate plate which closely surrounds the wheel 31. A modified form of cowl shown in FIG. 10, incorporates a circumferential channel having weirs 55 to dam back the coolant and slow its movement through the channel and force it inwardly towards the wheel 31 and wire W.

Figure 10:
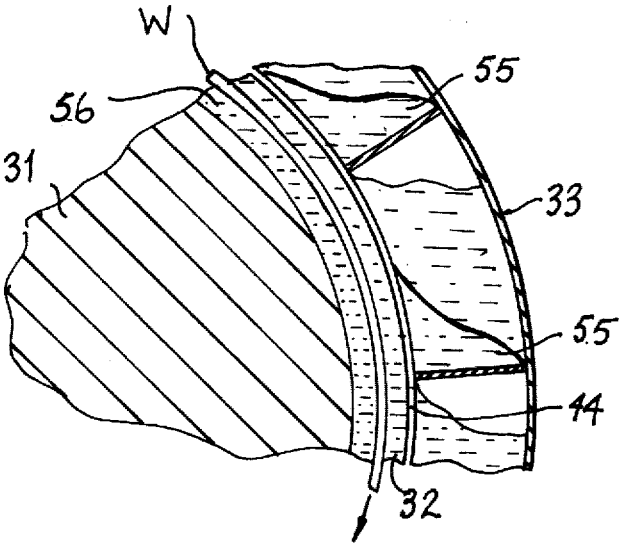
FIG. 10 is an enlarged partial section view showing part of the periphery of the wheel in FIG. 8 and a cowl used to enhance the cooling effect on the wire being drawn.

FIG. 10 also shows the coolant trapped by the wire in the groove 32 as indicated at 56.

The angle of the groove 32 can vary slightly (e.g. by a few degrees) throughout its depth (e.g. by making one or both surface(s) of the wheel 31 which define(s) the groove slightly curved). In this way, the smallest diameter wire could be located in an inner groove section having a different groove angle providing a lower wedging force than on the wire of largest diameter. Such an arrangement can reduce the overall depth of the groove and can ease the removal of the smaller diameter wires from the groove.

The air wipe 39 preferably comprises a chamber surrounding the wire which is limited at its ends by apertured plates whose wire-receiving apertures are only slightly larger than the cross-section of the wire. The chamber can be fed with compressed air (e.g. at a pressure of about 30 psig), the air stream leaving the chamber through the end plates (and particlarly the upstream end plate) to remove all remaining water from the surface of the wire.

The soap box 35 can contain either water-soluble or water-insoluble soaps and the examples provided in the following table gives an indication of the performance obtained using three kinds of wire lubricant in a two stage prototype machine (having the configuration shown in FIG. 8) and one of those lubricants on a two stage prior art capstan block machine using direct wire cooling and operated under ideal conditions.

In the Table, the feedstock was 5.5 mm diameter, 0.67 wt% carbon steel rod having a phosphate and borax chemical coating for effectively adhering the lubricant to the wire. Soap "1164HS" is a sodium-based soap and soap "2056" is a calcium-based soap (both available from Colliers Limited). Soap "C and F" is a 1:1 mixture of coarse and fine grained calcium-based soap known under the Trade Name "WYRAX".

On the prototype machine some 15 liters/minute of cooling water at 15° C. was supplied to the elongated shroud tube 37. The temperature of the cooling water increased some 10° C.

TABLE

| | FEED STOCK | PROTOTYPE MACHINE 2 Die 1164HS | 2 Die 2056 | 2 Die C and F | PRIOR ART MACHINE 2 Die C and F |
|---|---|---|---|---|---|
| Input Material (ϕmm) | — | 5.50 | 5.50 | 5.50 | 5.50 |
| 1st Die (ϕmm) | — | 4.33 | 4.33 | 4.33 | 4.33 |
| Output Material (ϕmm) | — | 3.45 | 3.45 | 3.45 | 3.45 |
| Drawing speed at output (m/sec) | — | 3.05 | 3.05 | 3.05 | 3.00 |
| U.T.S. ($N/mm^2$) | 945 | 1345 | 1351 | 1351 | 1359 |
| Torsions (100D) | — | 41 | 41 | 40 | 32 |
| Bends (10mm) | — | 17,15 | 16,15 | 15,15 | 15,14 |
| R of A (%) | 50 | 53 | 53 | 53 | 55 |
| Elongation (%) 250mm | 6.8 | 2.4 | 2.4 | 2.6 | 2.2 |
| DRAWING COAT WEIGHTS | | | | | |
| Soap ($mg/m^2$) | — | 705 | 827 | 437 | 1021 |
| Water Soluble ($mg/m^2$) | 7913 | 225 | 308 | 471 | 600 |
| Caustic Soluble ($mg/m^2$) | 7144 | 2570 | 3855 | 3781 | 2642 |
| Total Residual Coat ($mg/m^2$) | 15057 | 3500 | 4990 | 4689 | 4263 |

In the Tables "U.T.S." stands for ultimate tensile strength. "Torsions (100D)" means the number of 360° twists that can be accommodated in a length equal to 100 wire diameters before fracture occurs—"Bends (10 mm)" means the number of bends of 10 mm radius which can be undertaken before fracture (two tests recorded each time). "R of A (%)" gives the reduction in area at the neck during a tensile test just prior to fracture and "Elongation (%) 250 mm" gives the elongation of a 250 mm sample just prior to fracture.

Apparatus in accordance with the invention has many significant advantages over conventional wire drawing machines. The most important of these are as follows:

(i) The problems associated with a multiplicity of turns on a block will be avoided. This means that threading-up time will be reduced (as there will be no question of running this machine solely to fill the blocks).

(ii) The range of wire diameters which are suitable for a particular wheel size, will no longer be determined by consideration of block taper and block root radius to obtain the necessary axial movement of the wire. Thus a much wider range of wires can be drawn on a particular wheel size, which will give a reduction in the number of wheel sizes and models required, compared with the wide variety of blocks in use at present.

(iii) The grooved wheels are designed in such a way that merely by dismantling the two halves of the wheel, reversing them, and re-assembling, a second groove is made available. Furthermore, because the groove is tapered, the positions of the two arcs of contact (one on either side of the groove) depend upon the wire diameter being drawn. The smaller the wire diameter, the smaller the radius of the arcs of contact and vice-versa. This means that there is scope on a multi-hole machine, to move the wheels progressively along the machine and so obtain still more useful life before reconditioning. Due to their simplicity, it is anticipated that the cost of the drawing wheels will be much less than conventional wire drawing blocks.

(iv) The compactness and mechanical simplicity of the machine facilitates maintenance and reduces the range of spares needed.

(v) The machine is much easier to thread-up. With the wheel axes horizontal, the wheels are very accessible. The simple lay-out lends itself to fully automated threading-up.

(vi) The machine is much quieter in operation than prior art machines since there is no sliding of wire on the blocks and no need for block cooling fans.

(vii) The wire is at all times taut and under control. Thus the slackness of wire on blocks with the consequent erratic pay-off is avoided. The problem caused by resistance to climbing of wire on a block, often encountered in a prior art machine after a stop and due to changing block cooling and friction conditions, is eliminated.

(viii) The reduced wire length between dies coupled with bending substantially only in one plane, results in improved control over the wire and thus no need to cast the wire at each die. This enhances die life, improves consistency of lubrication and ensures that symmetrical deformation of the wire is achieved at the dies.

(ix) Although the use of grooved wheels in this invention is novel, the layout of the machine in respect of feeding input stock into the machine and taking up the finished wire from the machine can be conventional.

Therefore conventional feed equipment and existing designs of spoolers or coilers can be used.

(x) It is possible to draw both bright and galvanized ferrous material on the same machine since block taper and wire "climb" considerations are no longer relevant.

(xi) The very rapid cooling produced by maintaining the wire in contact with a flow of liquid coolant from the draw die outlet to where the wire emerges from the draw wheel, permits higher than normal drafts to be drawn at each stage, permits the same overall draft to be carried out in a reduced number of stages, and permits an advantageous drawing apparatus of the type described to be employed in place of the prior art capstan type drawing apparatus.

As will be apparent to persons skilled in the art, various modifications, adaptations and variations of the foregoing specific disclosure can be made without departing from the teachings of the present invention.

We claim:

1. In a method of drawing ferrous wire employing a plurality of drawing stages for continuously drawing the ferrous wire to successively smaller sizes, with each stage comprising a wire drawing die for reducing the size of the wire, a soap box upstream of the die having a dry wire lubricant for lubricating the ferrous wire for drawing the wire to a smaller size and a rotatable drawing wheel downstream of the die operable to draw the wire through the die, the improvement wherein said method comprises, at each of a plurality of successive drawing stages, drawing the ferrous wire through the respective die with the respective drawing wheel by wedging the wire within a peripheral circular wedging groove of the drawing wheel for less than one turn therearound, the circular wedging groove being coaxial with the axis of rotation of the drawing wheel, and continuously conducting a water based, liquid coolant into contact with the ferrous wire along the wire path from the die to the drawing wheel and while the wire is within the wedging groove of the drawing wheel, and drying the wire between each upstream drawing wheel and downstream soap box of said plurality of successive drawing stages.

2. A method as claimed in claim 1 wherein the cooling step comprises feeding the coolant into a moving column of liquid to surround the wire as it leaves the die and to remain around the wire at least until it enters the groove.

3. A wire drawing method comprising at least one drawing stage having the steps of drawing a wire through a die with a rotating drawing wheel mounted downstream of the die by drawing the wire with the wheel by wedging the wire in an arc of less than 360° of an endless wedging groove of the rotating drawing wheel, and directly cooling the wire between the die and the wheel and while the wire is in the wedging groove of the wheel with a flow of liquid coolant in contact with the wire including feeding the coolant into a moving column of liquid to surround the wire as it leaves the die and to remain around the wire at least until it enters the groove, and employing the liquid coolant forming said column for cooling the die and feeding the liquid coolant to form said column with the coolant turning helically around the wire along the wire path between the die and drawing wheel.

4. A method as claimed in claim 3 comprising a plurality of said drawing stages in succession and wherein the wire is drawn successively through a series of progressively smaller dies in the successive stages respectively and removing the liquid coolant from the wire surface between the drawing wheel of each preceding stage and the die of the next following stage.

5. In a method of drawing wire employing a plurality of drawing stages for continuously drawing the wire to successively smaller sizes, with each stage comprising a wire drawing die for reducing the size of the wire, a soap box upstream of the die having a dry wire lubricant for lubricating the wire for drawing the wire to a smaller size and a rotatable drawing wheel downstream of the die operable to draw the wire through the die, the improvement wherein said method comprises, at each of a plurality of successive drawing stages, drawing the wire through the respective die with the respective drawing wheel by wedging the wire within a peripheral circular wedging groove of the drawing wheel for less than one turn therearound, the circular wedging groove being coaxial with the axis of rotation of the drawing wheel, and continuously cooling the wire by continuously conducting a water based liquid coolant into contact with the wire along the wire path from the die to the drawing wheel and into the wedging groove into contact with both the drawing wheel and the wire along the path of the wire within the wedging groove, and drying the wire between each upstream drawing wheel and downstream soap box of said plurality of successive drawing stages.

6. A method as claimed in claim 2, in which the groove in the drawing wheel is of substantially V-form and has an included angle of between 15° and 25°.

7. A method as claimed in claim 6, in which the V-groove is symmetrical about a plane normal to the rotating axis of the wheel.

8. A method as claimed in claim 2, in which the wire is wedged into the groove of the wheel along an arc of between 180° and 270°.

9. A method as claimed in claim 4, 1 or 5, in which the wire remains in generally a single plane from its entry to the die of the first stage until its departure from the drawing wheel of the last stage of said plurality of successive drawing stages.

10. A method as claimed in claim 2, 4, 1 or 5, in which in each of said plurality of successive drawing stages, the wire is cooled following exit from the die in a time of from 0.1 to 5 seconds.

11. A method as claimed in claim 2, 7, 1 or 5, in which the speed of rotation of the drawing wheel of each preceding stage is controlled by sensing the wire tension in the wire path between that wheel and the die of the next downstream stage.

12. A method as claimed in claim 11, in which the wire tension is sensed with a force transducer acted on by a guide pulley controlling the wire path in the said wire path.

13. In a wire drawing apparatus having a plurality of drawing stages for continuously drawing wire to successively smaller sizes respectively, with each drawing stage comprising a wire drawing die for reducing the size of the wire, a soap box upstream of the die having a dry wire lubricant for lubricating the wire for drawing the wire to a smaller size and a rotatable drawing wheel downstream of the die operable to draw the wire through the die, the improvement wherein in each of a plurality of successive drawing stages of the drawing apparatus, the drawing wheel comprises a peripheral circular wedging groove, coaxial with the axis of rotation of the drawing wheel, for wedging the wire within less than one turn around the wheel for drawing the wire with the drawing wheel through the respective die, and wire cooling means for continuously conducting a water based coolant into contact with the wire along the wire path from the die to the drawing wheel and while the wire is within the wedging groove of the drawing wheel, and wherein the apparatus comprises an air wipe for drying the wire between each upstream drawing wheel and downstream soap box of said plurality of successive drawing stages.

14. Apparatus as claimed in claim 13, in which the wire cooling means provides for directing liquid coolant to contact the wire immediately downstream of the die and into the wheel groove below the wire.

15. Apparatus as claimed in claim 14 wherein the cooling means comprises a cowl closely confronting the periphery of the rotating wheel for retaining coolant against the radially outer surface of the wire in the groove.

16. Apparatus as claimed in claim 13, wherein in each of said plurality of successive drawing stages, the wheels are disposed one after the other with their grooves lying in a generally common plane.

17. Apparatus as claimed in claim 13 or 16 wherein in each of said plurality of successive drawing stages the wheels are mounted with their axes horizontal.

18. Apparatus as claimed in claim 13 or 16 wherein each of said plurality of successive stages comprises a drawing wheel casing enclosing the drawing wheel so that the portion of wire wedged in its groove can be drenched with liquid coolant during use of the apparatus without coolant impinging on coolant-free parts of the wire path.

19. Apparatus as claimed in claim 13 or 16 further comprising guide pulley means in the wire path between each air wipe and the next die which senses the magnitude of the back tension in the wire path and controls the speed of the adjacent upstream wheel.

20. Apparatus as claimed in claim 13 or 16 in which generally the same size drawing wheels are used in said plurality of successive drawing stages, and whereby the wire contacts different regions of the groove at different stages.

21. Apparatus as claimed in claim 13 in which each of said drawing wheels is made in two parts which are clamped together at a meeting plane which passes through the groove.

22. Apparatus as claimed in claim 21 in which the two parts of each wheel are shaped so that a new groove can be formed by reversing the two parts and clamping them together again back to back.

23. In a wire drawing apparatus comprising at least one wire drawing stage having a wire drawing die for reducing the cross-section of the wire, a soap box upstream of the die having a dry wire lubricant for lubricating the wire for drawing the wire to a smaller size and a rotatable drawing wheel downstream of the die operable to draw a wire forwardly along a wire transport path extending through the soap box and die, the improvement wherein the drawing wheel has a single peripheral circular wedging groove, coaxial with the axis of rotation of the drawing wheel, with opposed wedging surfaces for wedging the wire therebetween for drawing the wire with the drawing wheel forwardly along the wire transport path through the soap box and die and partly around the drawing wheel, guide roll means for guiding the wire from the wedging groove of the drawing wheel and so that the wire transport path extends less than 360° therearound, and liquid cooling means for directly and continuously conducting a liquid coolant into contact with the wire along its transport path from the die to the drawing wheel and while the wire is within the wedging groove, the die and drawing wheel being aligned to draw the wire forwardly along a substantially linear path through the die in generally the plane of the peripheral wedging groove and directly onto the drawing wheel, and the guide means guiding the wire from the wedging groove of the drawing wheel to cross the wire transport path upstream of the die and slightly offset from the path and then forwardly generally in the plane of the peripheral wedging groove of the drawing wheel.

24. A wire drawing apparatus according to claim 23 wherein the drawing wheel is mounted with its axis generally horizontal and its circular wedging groove in a generally vertical plane and wherein the wire transport path extends from the die and over the wheel and the guide roll means provides for guiding the wire from under the drawing wheel.

25. A wire drawing apparatus according to claim 23 or 24 wherein the apparatus comprises a plurality of said drawing stages and wherein the drawing wheels of the plurality of stages are aligned with their circular grooves in generally the same plane.

26. A wire drawing apparatus according to claim 23 or 24 wherein the liquid cooling means comprises an elongated liquid coolant jacket surrounding the wire transport path between the die and the groove of the drawing wheel for directly cooling the wire with liquid coolant within the jacket and to feed liquid coolant along the wire and into the groove.

* * * * *